US010850323B2

(12) United States Patent
Mancini

(10) Patent No.: US 10,850,323 B2
(45) Date of Patent: Dec. 1, 2020

(54) APPARATUS FOR THE HOT-CHAMBER DIE CASTING OF NON FERROUS ALLOYS

(71) Applicant: Flavio Mancini, Brescia BS (IT)

(72) Inventor: Flavio Mancini, Brescia BS (IT)

( * ) Notice: Subject to any disclaimer, the term of this patent is extended or adjusted under 35 U.S.C. 154(b) by 0 days.

(21) Appl. No.: 16/486,641

(22) PCT Filed: Mar. 21, 2018

(86) PCT No.: PCT/IB2018/051894

§ 371 (c)(1),
(2) Date: Aug. 16, 2019

(87) PCT Pub. No.: WO2018/178815

PCT Pub. Date: Oct. 4, 2018

(65) Prior Publication Data

US 2020/0009645 A1 Jan. 9, 2020

(30) Foreign Application Priority Data

Mar. 27, 2017 (IT) ..... 102017000033183

(51) Int. Cl.
*B22D 17/02* (2006.01)
*B22D 17/04* (2006.01)
(Continued)

(52) U.S. Cl.
CPC ..... *B22D 17/02* (2013.01); *B22D 17/04* (2013.01); *B22D 17/2015* (2013.01); *B22D 17/26* (2013.01); *B22D 19/16* (2013.01)

(58) Field of Classification Search
CPC ..... B22D 17/02; B22D 17/04; B22D 19/16
See application file for complete search history.

(56) References Cited

U.S. PATENT DOCUMENTS 2,145,448 A 1/1939 Nathan
4,085,791 A * 4/1978 Kaiser ..... B22D 17/14 164/473

(Continued)

FOREIGN PATENT DOCUMENTS

EP 0400274 A2 12/1990
JP 60076264 A * 4/1985 ..... B22D 17/02
WO WO-2018178815 A1 4/2018

OTHER PUBLICATIONS

International Search Report and Written Opinion for International Application No. PCT/IB2018/051894, dated Jun. 8, 2018, European Patent Office, Netherlands, 13 pages.

*Primary Examiner* — Kevin E Yoon
(74) *Attorney, Agent, or Firm* — Sterne, Kessler, Goldstein & Fox P.L.L.C.

(57) ABSTRACT

An apparatus for the hot-chamber die casting of non-ferrous alloys essentially consists of a press (115) for the closing/opening of a mould (110, 111) and an injection group (112) comprising a pump body (102) immersed in a pot (124) of the molten alloy and in which an injector piston (116) slides, an actuator (108) connected to the injector piston (116), and a gooseneck formed of in the pump body (102) and ending with a heated extension (103) provided with a nozzle (104) for the connection to the mould (110, 111), two hydraulic jacks (114) being secured between the injection group (112) and the press (115) which is fixed, the injection group (112) being divided into a stationary bottom portion and a top portion movable on sloped guides (109) parallel to the longitudinal axes of the extension (103) and of the hydraulic jacks (114), the pot (124) being mounted on horizontal rails (120) and the hydraulic jacks (114) being secured to the pump body (102).

20 Claims, 5 Drawing Sheets

(51) Int. Cl.

| | |
|---|---|
| ***B22D 19/16*** | (2006.01) |
| ***B22D 17/20*** | (2006.01) |
| ***B22D 17/26*** | (2006.01) |

(56) References Cited

U.S. PATENT DOCUMENTS

| | | | | |
|---|---|---|---|---|
| 4,261,414 | A | 4/1981 | Frenette et al. | |
| 5,072,778 | A | 12/1991 | Fink et al. | |
| 6,390,175 | B1 | 5/2002 | Fink et al. | |
| 2001/0004931 | A1* | 6/2001 | Koda ..... | B22D 17/2061 164/312 |

* cited by examiner

APPARATUS FOR THE HOT-CHAMBER DIE CASTING OF NON FERROUS ALLOYS

The present invention relates to an apparatus for the hot-chamber die casting of non-ferrous alloys, and in particular to an apparatus for the production of large structural pieces.

It is known that both in cold-chamber systems, where the injection pump of the molten alloy is in air, and in hot-chamber systems, in which the injection pump is immersed in the molten alloy, for the injection of the alloy into the metal mould having a temperature of hundreds of degrees lower than that of the molten alloy, the solidification times of the casting and therefore the filling times of the mould become shorter as the thickness of the structural casting is reduced, even going down to 20 milliseconds: therefore a high filling speed and a high injection pressure are required.

Speeds and pressures are much lower in the hot-chamber process than in the cold-chamber process, due to the shorter paths of the alloy in the mould and to the heating of the casting supply system. This leads to the numerous advantages of the hot-chamber die casting process over the analogous cold-chamber process, such as:

- closed cycle even in temperature,
- negligible contents in the casting of air bubbles, slag, oxides, primary crystallization, porosities from lubricants, cold drops, etc.,
- less thermal shocks in the mould and therefore longer life of the moulds,
- lower ratio between gross and net mass of the casting,
- lower pressure on the alloy,
- lower closing forces of the moulds and therefore lower cost of the same and of the relative closure group,
- greater productivity and less waste,
- energy saving.

However, prior art hot-chamber apparatuses are not suitable for the die casting of large structural pieces because of the cost and difficulty of managing an apparatus of adequate size for such parts, as explained below with reference to the prior art schematically illustrated in FIGS. 1 and 2.

In FIG. 1 (not to scale) the mould closure group (or press) 15 and the injection group 12 of a known hot-chamber apparatus are shown. The injection group actuator 8, usually hydraulic, having to be external to the crucible 17 of the molten alloy, must have a motion close to the vertical and the pump must be a reciprocating pump, with a single cylinder (see for example EP 0400274, EP 1044743, U.S. Pat. Nos. 4,566,522, 4,505,317).

The connection with the fixed part of the mould takes place through a duct 1, the so-called "gooseneck" (siphon structure) formed in the pump body 2, and an extension 3 of the duct 1, connected to the body 2 and heated to high temperature to avoid solidification of the alloy and the obstruction of the connection. The extension 3 must necessarily be inclined towards the pump with respect to the horizontal attitude so as to allow the downflow towards the pump of the molten alloy not used in the solidified casting, so as not to favor the stagnation of oxidized or semi-solid alloy, which would compromise the quality of the subsequent castings.

The pressure tightness of the alloy is obtained by pressing with sufficient force the two parts 10, 11 of the mould against the nozzle 4 of the extension 3 through two hydraulic jacks 14, symmetrically placed with respect to the extension 3 and secured between the head of the press 15 and the injection group 12, which is integral with the base 13 of the apparatus fixed to the ground, so as to pull the press 15 which is slidable with respect to the ground.

During the production process it sometimes happens that the solidification of the casting 6, connected to the nozzle 4 of the extension 3 through a so-called "carrot" 5, continues beyond the carrot 5 towards the extension 3 preventing the casting 6 from detaching from the pump sub-group. The part which is in charge of the closing-opening of the mould 10/11, i.e. the press 15, is inclined on the horizontal with the same slope of the extension 3 thus allowing the forced removal of the press 15 (and of the closed mould) from the injection group 12 with consequent detachment 7 of the carrot 5 from the nozzle 4, suitably shaped. This situation is shown in FIG. 2, which represents the maximum travel of the detachment 7, with access to the nozzle 4 for maintenance operations on the same and on the extension 3 (the nozzle must be rigidly clamped on the extension or formed therein).

The detachment 7 is made possible by the actuation of the same pair of hydraulic jacks 14 used for adhering the mould to the extension 3, which being double-acting jacks move away, along sloped guides 9, the closure group 15 and the mould 10/11 from the injection group 12 integral with the base 13, the mass of the sliding part varying from a few tens to a few hundreds of kg.

The injector piston 16, which is a part subject to wear, must be replaced every few thousands of castings and as long as said element is manageable and of a weight sustainable by the operator, the operation is possible, but since it must also be preheated the operation may become dangerous.

In the more obsolete prior art there are also configurations of small machines with horizontal closure and vertical injection, where the extension is inclined, with one or both spherical ends of contact and seal. However, such a structure, in the event of an obstruction, requires a complicated disassembly of the extension or its overheating by means of an oxyacetylene flame or the like, which is structurally dangerous for the integrity of the extension, without considering the precarious sealing of the spherical connections (see for example U.S. Pat. No. 6,481,489).

The structure described in FIGS. 1 and 2 is a serious obstacle for the development of larger apparatuses compared to the current apparatuses, because the mass of the sliding part, press and mould therein included, would reach tens of thousands of kg and that of the stem and injector piston well over one hundred kg, preheated to high temperatures.

The sliding and inclined coupling for closing the mould on the injection pump is justified for small or medium-small machines, as long as the ratio between the volumes and the mass of the coupling is reasonable as in the hot-chamber systems currently in use. This system becomes excessively expensive and difficult to accept for large structural pieces, in which the ratio between surfaces and thicknesses is becoming ever larger and therefore the ratio of the volumes of the mass of the mould and therefore of the closing press becomes ever larger compared to the injection group.

The development of the hot-chamber process for large structural parts is also hampered by the need for frequent replacement of the injector piston 16, whose seals have a life of a few thousand cycles, because this element is difficult to manage due to being too heavy to handle and at high temperature. In addition there are difficulties in maintaining the molten alloy pump sub-group, which includes other limited-life organs, such as nozzle, heating bands, etc.

The object of the present invention is therefore to provide a hot-chamber die casting apparatus which overcomes the aforementioned drawbacks and the current dimensional limits of the hot-chamber process, extending it to large-sized structural castings. This object is achieved by means of an apparatus comprising a fixed press and an injection group divided into a stationary portion and a portion movable on sloped guides parallel to the extension and on horizontal rails, making such motions compatible with each other. Other advantageous features are recited in the dependent claims.

A first important advantage of the present apparatus lies precisely in the possibility of realizing also large structural pieces with the hot-chamber process thus obtaining all the aforementioned advantages with respect to the cold-chamber process.

A second significant advantage derives from the fact that also the management of the maintenance phases is simplified, thanks to the possibility of performing the replacement of the injector piston with an automatic or semi-automatic device and of being able to operate safely even during the cleaning of the crucible and/or the maintenance or replacement of the molten alloy pump sub-group.

Yet another advantage of the proposed configuration consists in the possibility of easily replacing the cold-chamber injection group of an existing apparatus with the new hot-chamber injection group, since in all medium and large apparatuses the injection group is separated from the rest of the apparatus therefore it is easy to disconnect the old group and connect the new group in a few working days.

Furthermore, the proposed configuration can allow the association of two or more injection groups to the same mould closing system, horizontal or vertical, allowing in said embodiment to inject even different alloys in the same cavity.

These and other advantages and characteristics of the die casting apparatus according to the present invention will be clear to those skilled in the art from the following detailed description of two embodiments thereof with reference to the attached drawings in which.

Figure 1:
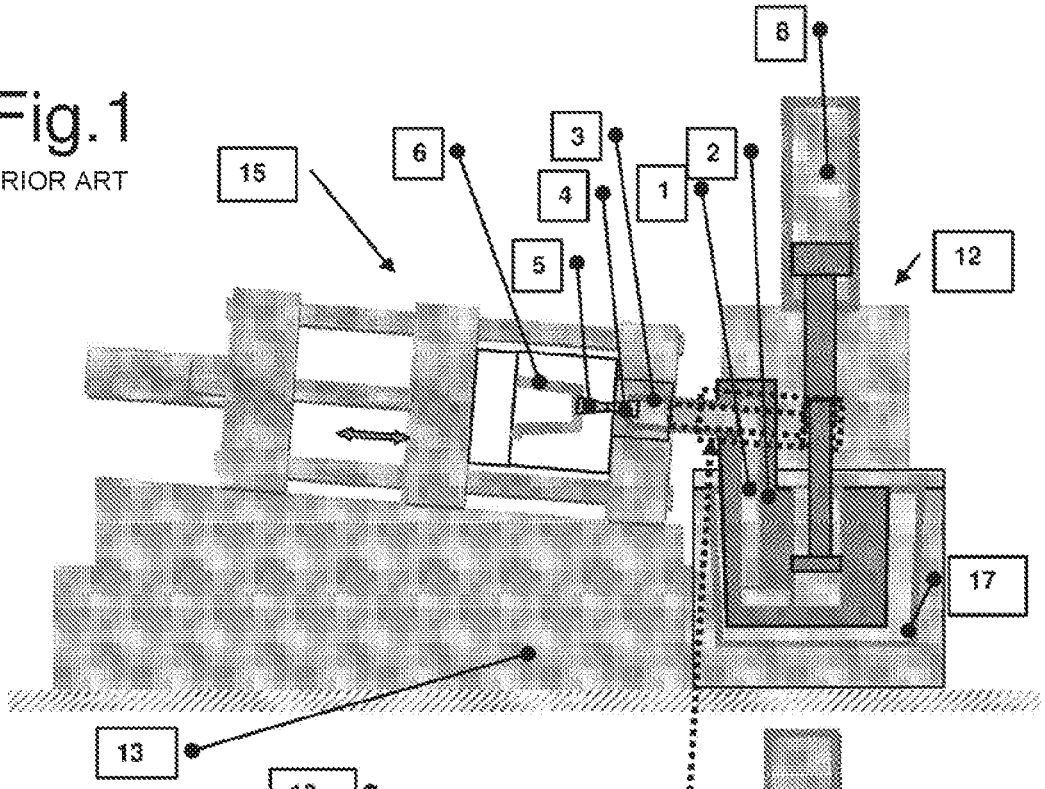
Fig.1 PRIOR ART
FIGS. 1 and 2 show a schematic view in longitudinal section of a prior art apparatus in a position of closed mould (with full cavity) and detachment of the carrot, respectively, as described above.
Figure 2:
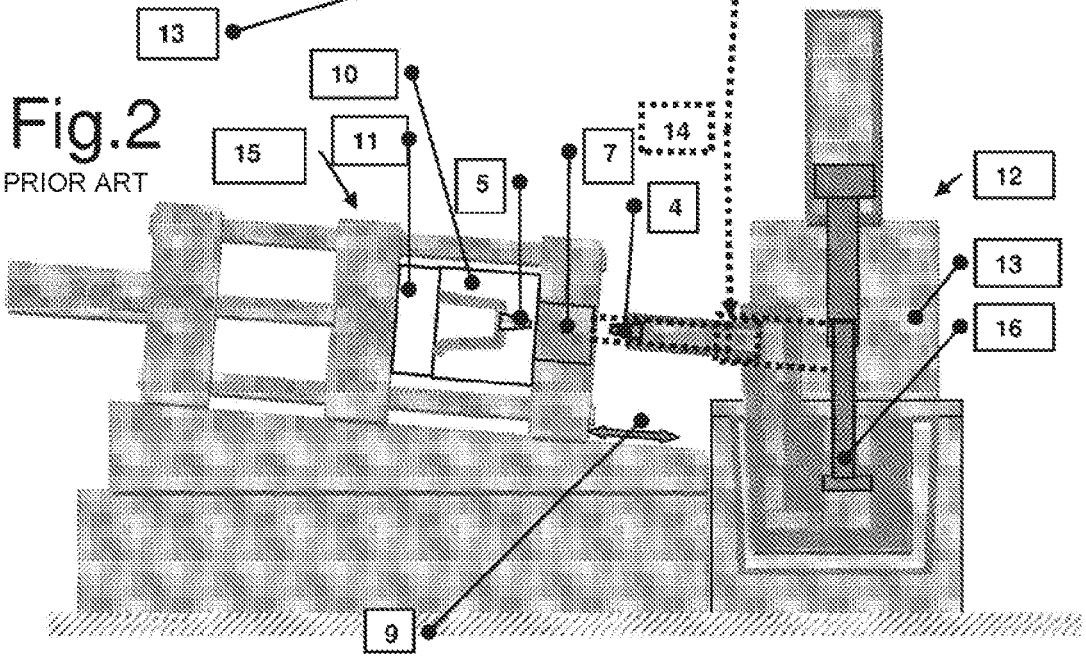
Fig.2 PRIOR ART
Figure 3:
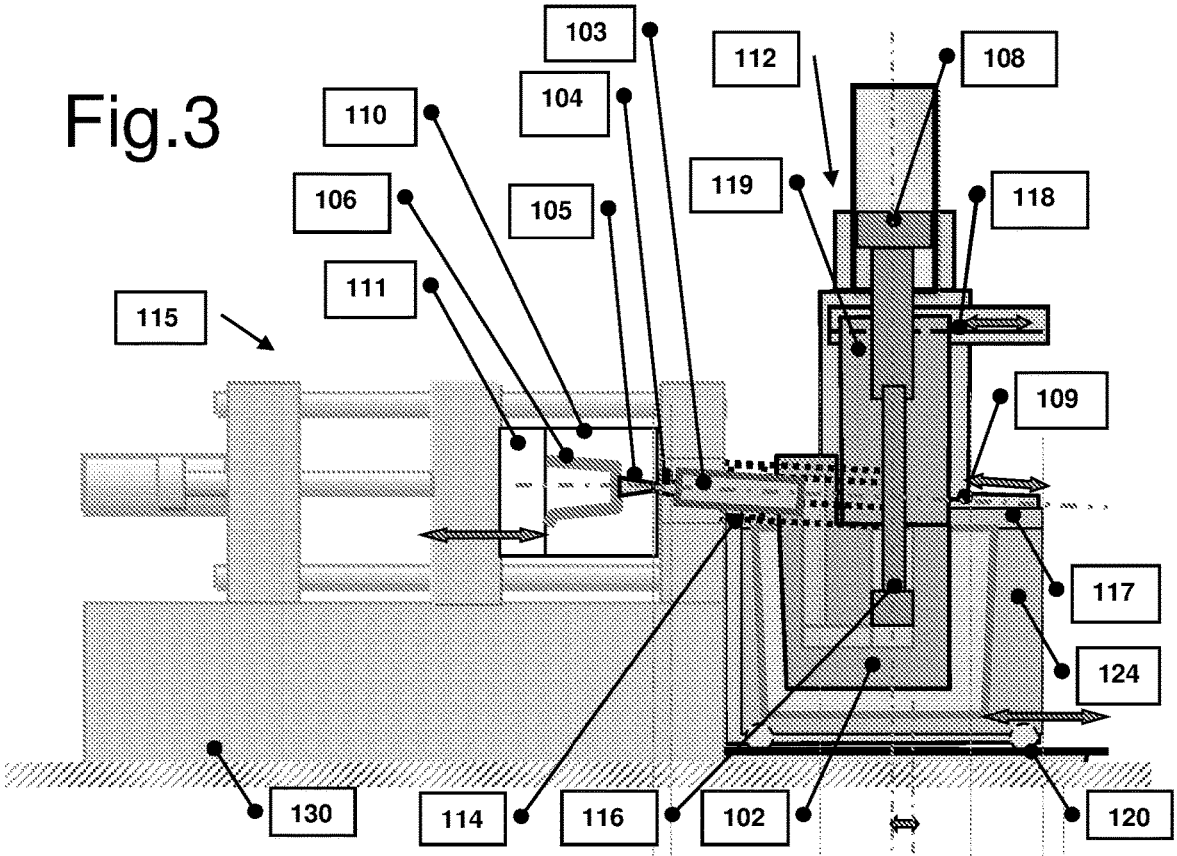
FIGS. 3 and 4 show a schematic view in longitudinal section of a first embodiment of a hot-chamber die casting apparatus according to the present invention in a position of closed mould (with full cavity) and detachment of the carrot, respectively.
Figure 4:
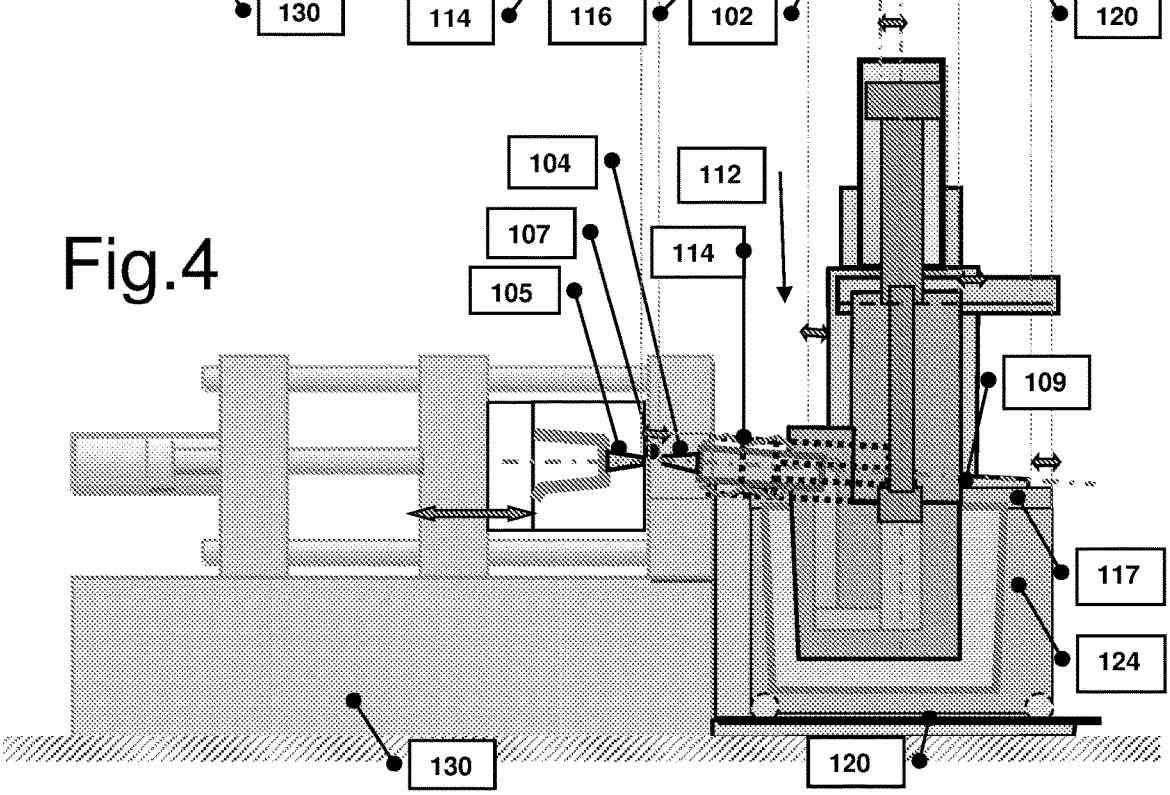
Figure 5:
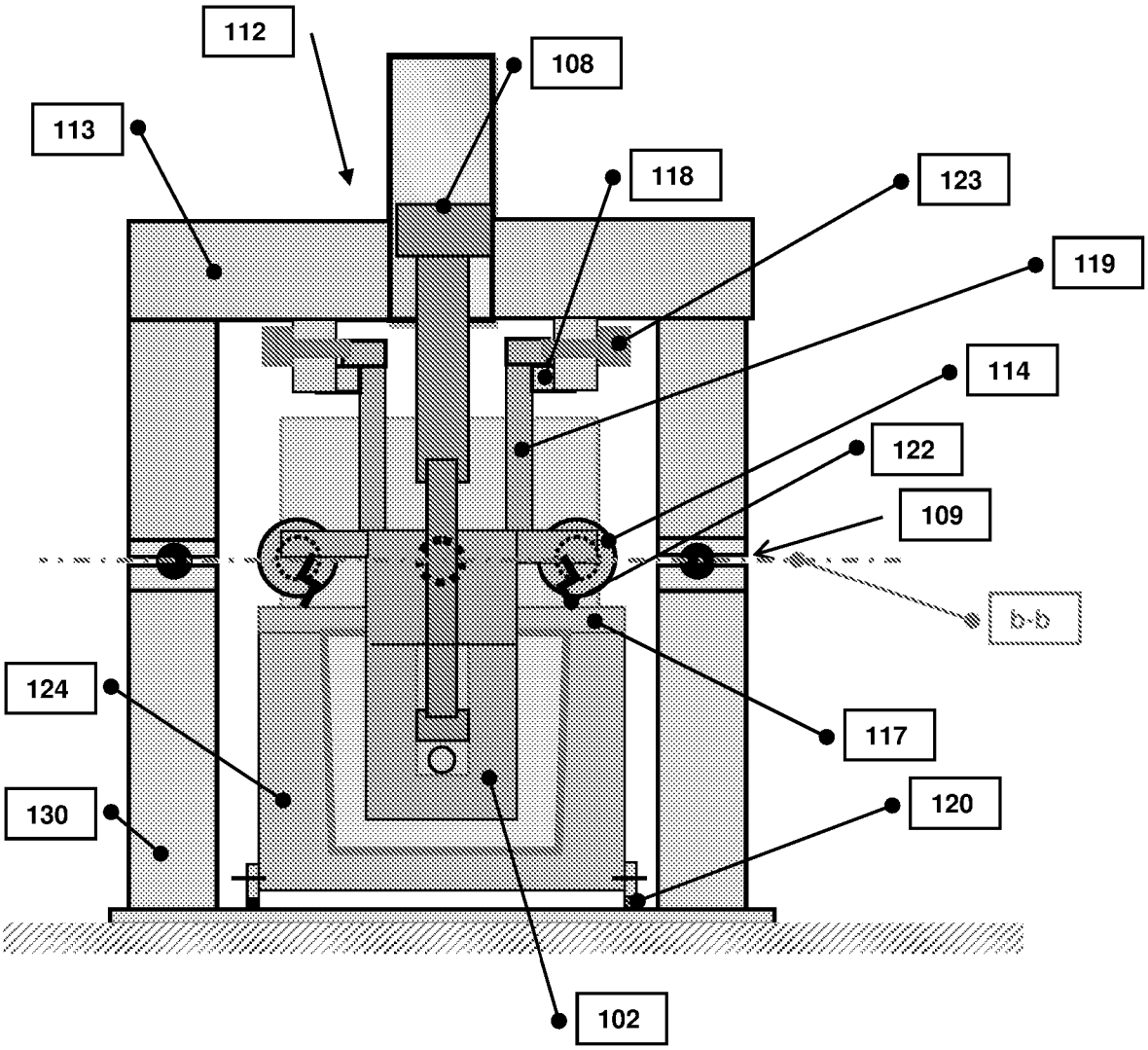
FIG. 5 shows a schematic view in cross section of said apparatus.

With reference to FIGS. 3 to 5, there is seen that a hot-chamber die casting apparatus according to a preferred embodiment of the present invention comprises a base 130 carrying a closure group 115 of the two half-moulds 110 and 111, that enclose the cavity 106 of the mould, which is with horizontal attitude and guides as in the common cold-chamber apparatuses. The axis of the extension 103 is instead inclined on the horizontal, similarly to the current hot-chamber apparatuses, and the axis of the molten alloy pump and of its actuator 108 is vertical.

The body 102 of the pump is constrained and elastically supported, by means of supports 122 of known type, by the structure of the pot 124 in which it is immersed and, in the injection phase, is coaxially connected to the actuator 108 of the injector piston 116. If necessary, the body 102 can be free to slide on top horizontal guides 118, integral with the crossbar 113 which carries the actuator 108, to which it is hung by means of two brackets 119, symmetrical with respect to the axis of the actuator 108. During the injection, the brackets 119 serve to create a closed loop of forces between the pump and its actuator.

The injection group 112 is free to slide on two sloped guides 109 (preferably of the rolling type) disposed at the top of the parts of the base 130 which flank the injection group 112. The guides 109 are parallel to the inclined axis of the extension 103 and to the axes of the adherence jacks 114, and even preferably coplanar with said axis of the extension 103 and with the axes of the jacks (plane with trace b-b of FIG. 5), so as not to transmit moments with respect to the point of intersection between the axes of the nozzle 104 and of the carrot 105 and with respect to the extension 103.

The travel on the guides 109 can be limited to the maximum elongation at break of the carrot 105, with adjustable and elastic mechanical stops not shown. Notwithstanding the fact that the travel along the guides 109 must guarantee the tight adherence of the nozzle 104 to the mould 110/111, the aforesaid elastic stops may also serve to establish the virtual center of said travel, which in any case can be otherwise determined by any of the methods known in the art, such as position transducers connected to the jacks 114.

The operation of the production cycle is similar to the most up-to-date techniques for small and medium castings, namely closing of the mould, injection and compacting of the casting, solidification of the same, cooling of the casting and return of the injector piston, opening and filling of the injector cylinder, extraction of the casting, cleaning and lubrication and cooling of the mould, closing of the mould, etc.

While the previous technique provided for the carrot tear at each cycle, the current production technique, thanks to the progress in temperature control, requires that the adherence of the extension to the mould remains, reduced during the opening of the mould, and that it is interrupted only in in the event that the solidification of the casting propagates to the nozzle. This eventuality cannot be avoided in case of anomaly in the temperature control, and in this case the junction between extension and mould would prevent the continuation of the production cycle, therefore the apparatus must be equipped anyway for tearing the carrot.

FIG. 4 represents the apparatus upon performing the tear, thanks to the adherence jacks 114 which intervened with sufficient force and stroke by moving the pump body 102 away from the press 115 and sliding the injection group 112 along the inclined guides 109, thus dragging the pot 124 along the horizontal rails 120, such motions being compatible thanks to the elastic supports 122. Jacks, pump body, extension, nozzle and carrot create a closed loop of forces.

In this way, the heaviest part of the apparatus, consisting of the press 115 and the mould 110/111, remains stationary, while only the injection group 112, easily slidable, much less heavy and bulky, is moved.

Furthermore, the injection group 112 is divided into a top portion comprising the actuator 108 mounted on the crossbar 113 provided with the guides 118, and a bottom portion comprising the pump body 102 which contains the injector piston 116 and is in turn contained in the pot 124.

Figure 6:
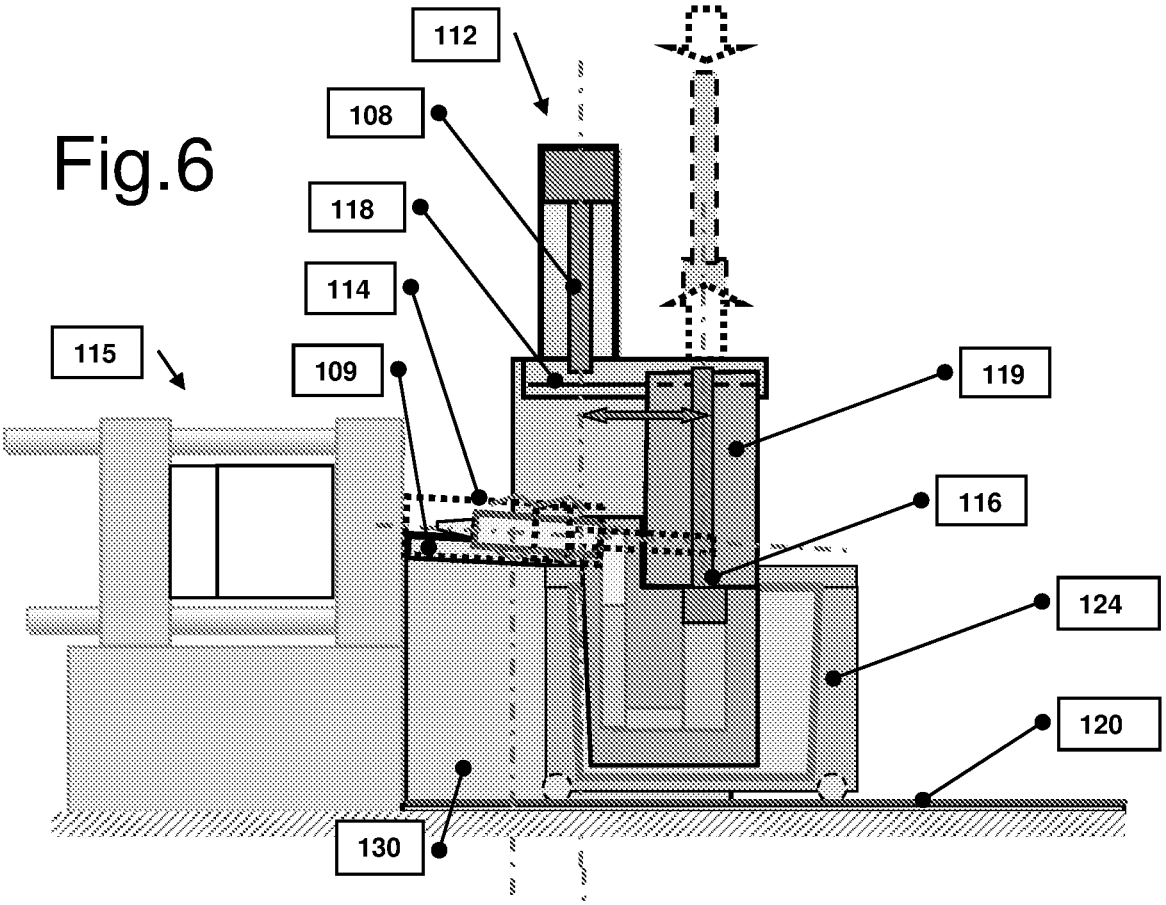
FIG. 6 shows a partial schematic view in longitudinal section of said apparatus in the position for the replacement of the injector piston.

FIG. 6 shows the apparatus in the position for the replacement of the injector piston 116, this position being reached thanks to the action of the jacks 114 but only after having given consent to the trespassing motion by opening the bolts 123 (FIG. 5) which serve to guarantee the coaxiality between the piston 116 and the actuator 108 during the normal operating steps and the possible tearing of the carrot. With the bolts 123 open and interlocked with the actuator 108, the jacks 114 push the pump body 102 which by means of the brackets 119 slides on the guides 118 dragging the pot 124 therewith, thus moving the piston 116 out of axis with respect to the actuator 108.

Unlike what happens in the carrot detachment phase, shown in FIG. 4, in this case the top portion of the injection group 112 remains stationary since the actuator 108 is disengaged from the piston 116 and therefore the action of the jacks 114 on the pump body 102 is transmitted only to the pot 124 through the supports 122 and its cover 117. Note that the pump is supported mainly by the cover 117 of the pot 124 through the elastic support system 122, so that the sliding along the guides 118 is smooth since these guides are practically unloaded given that the system weighs on the rails 120 but is directed by the guides 118, which determine the position of the pump. This allows the quick replacement of the injector piston 116 with total safety by means of an automatic or semi-automatic loader, preferably Cartesian and dedicated, not shown.

Figure 7:
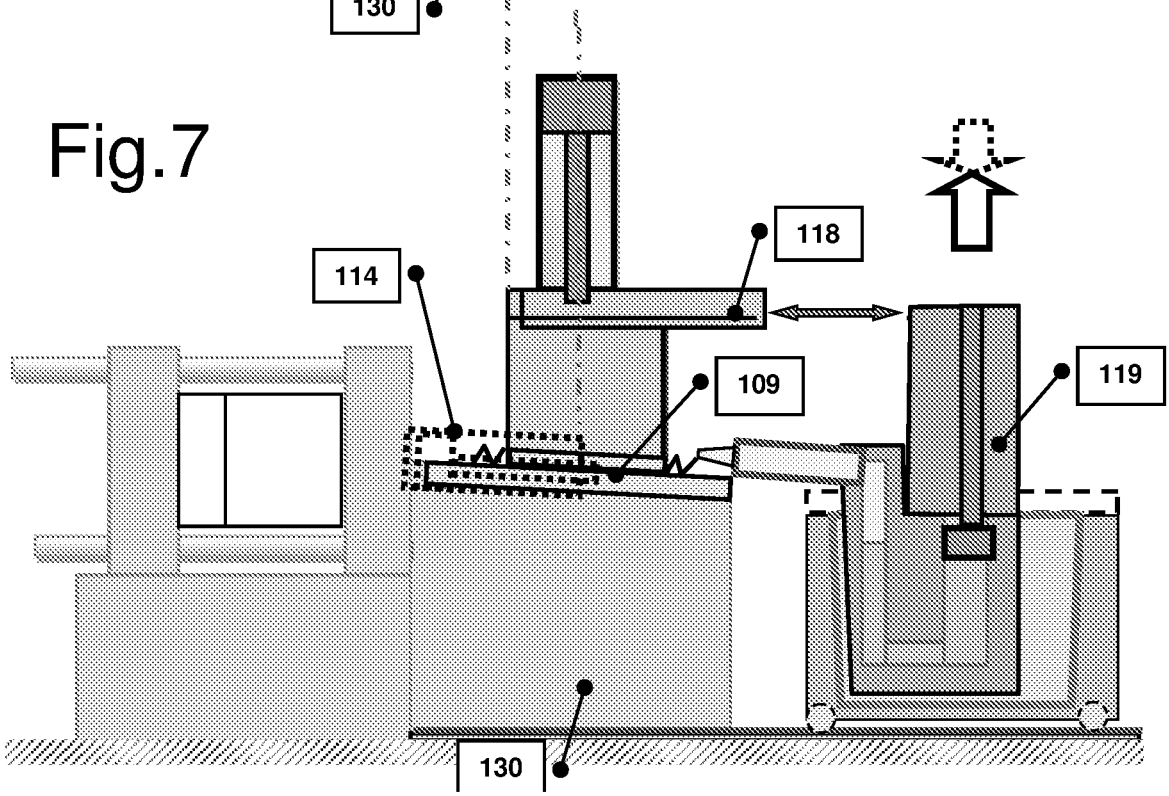
FIG. 7 shows a partial schematic view in longitudinal section of said apparatus in the position for the cleaning of the crucible and/or the maintenance/replacement of the molten alloy pump sub-group.

Similarly, FIG. 7 shows the apparatus in the position for the cleaning of the pot 124 and/or the safe maintenance or replacement of the molten alloy pump sub-group, with a weight even of several thousand kg, the operation being made easy and safe by the elastic suspension 122 of the pump sub-group to the casing of the pot 124. Also in this case, the top portion of the injection group 112 remains stationary since the actuator 108 is disengaged from the piston 116, but the pot 124 is moved by any prior art system, not shown, since the required displacement is greater than the stroke of the jacks 114 which are therefore disengaged at one of their two ends (for example at the pump end in FIG. 7) so that the pump sub-group can move back along the rails 120 with the brackets 119 which disengage from the guides 118.

Figure 8:
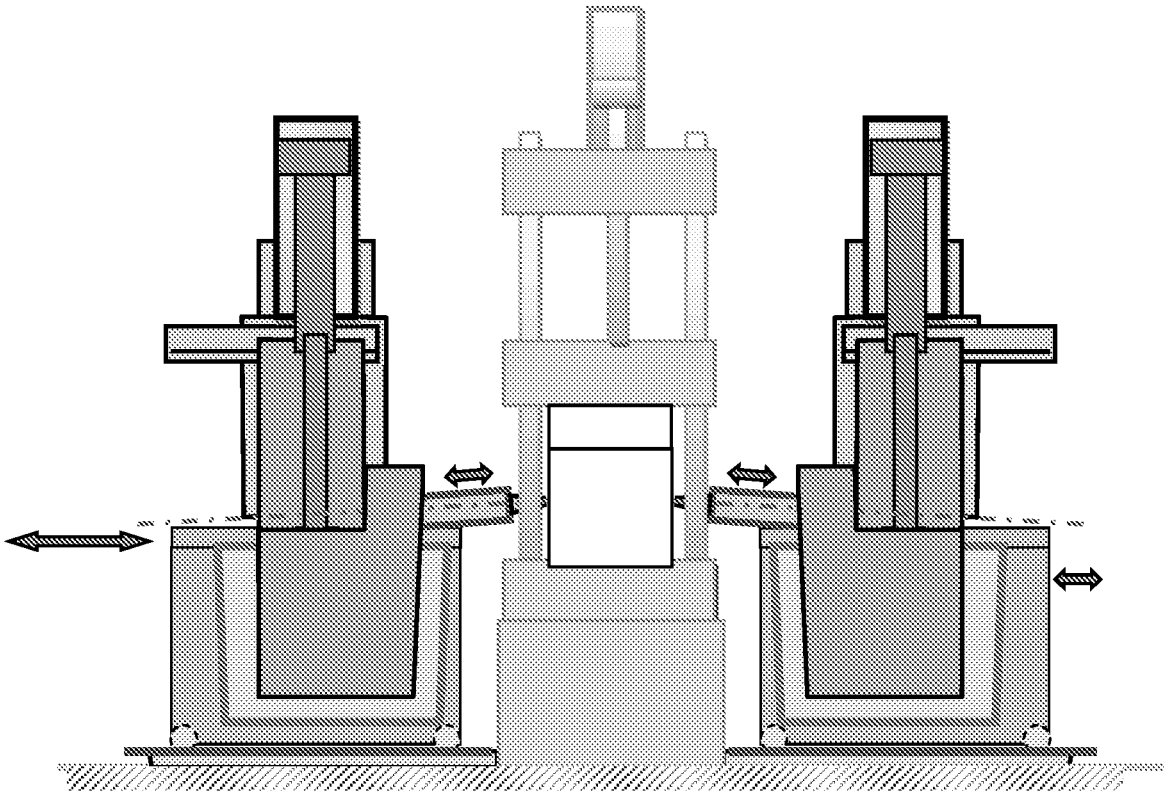
FIG. 8 shows a schematic view in longitudinal section of a second embodiment of an apparatus, with vertical closure of the mould and two injection groups.

FIG. 8 represents an apparatus with vertical closure of the mould, provided with two injection groups that are able to inject two identical or different alloys into the mould, simultaneously or in succession with each other. This makes it possible to produce castings of dimensions that are unimaginable with current techniques, even bimetallic or polymetallic, through dedicated injection groups that could even be more than two.

It is clear that the embodiments of the apparatus according to the invention described and illustrated above are only examples susceptible of numerous variations. In particular, the elements have been described in a schematic way since it is within the normal ability of a person skilled in the art to replace them with other technically equivalent ones, for example the double-acting hydraulic jacks 114 can be replaced by similar actuators capable of performing the same functions of adherence of the mould 110/111 to the nozzle 104, of detachment 107 of the carrot 105 and of retraction of the piston 116 for its replacement.

The invention claimed is:

1. An apparatus for the hot-chamber die casting of non-ferrous alloys, consisting essentially of:

a) a mould made up of two semi-moulds, b) a press for closing/opening said mould, c) a base carrying said press, d) an injection group comprising:

i) a pump body partially or totally immersed in a molten alloy contained in a pot, ii) an injector piston that slides in said pump body, iii) an actuator mounted on a crossbar above said pot and reversibly connected to said injector piston to drive it into a reciprocating motion, iv) a gooseneck formed in the pump body, v) a heated extension arranged at an external end of said gooseneck and provided with a nozzle for the connection to the mould, said nozzle being located higher than an opposite end of said extension such that the latter has a slope towards the gooseneck, and e) at least two double-acting hydraulic jacks arranged symmetrically with respect to the extension and secured, with a slope equal to the slope of the extension, between the pump body of the injection group and the portion of said press closest thereto, said apparatus being characterized in that the press is fixed and the injection group is mobile along sloped guides arranged on said base, said sloped guides being parallel to and coplanar with the longitudinal axes of the extension and of said hydraulic jacks, and in that the injection group is divided into a top portion, comprising the actuator and the crossbar, and a bottom portion comprising the pump body the injector piston and the pot, the latter being mounted on horizontal rails.

2. The apparatus according to claim 1, characterized in that the pump body is restrained to the pot through elastic supports, and it is hung through brackets to top horizontal guides that are integral with the crossbar.

3. The apparatus according to claim 2, characterized in that it further includes bolts that guarantee a coaxiality between the injector piston and the actuator during normal operative phases and upon opening allow the brackets to slide along the top horizontal guides.

4. The apparatus according to claim 3, characterized in that it further includes an automatic or semi-automatic loader, of the Cartesian type, for a rapid replacement of the injector piston when it is disengaged and out of axis with respect to the actuator, upon sliding of the brackets along the top horizontal guides.

5. The apparatus according to claim 3, characterized in that it further includes a device that moves the pot along the horizontal rails until it is disengaged from the top portion of the injection group, upon disengagement of the injector piston from the actuator and of the hydraulic jacks at one end thereof.

6. The apparatus according to claim 3, characterized in that it includes two or more injection groups connected to the mould so as to inject therein same or different alloys, simultaneously or at successive times.

7. The apparatus according to claim 3, characterized in that the press is arranged with a horizontal or vertical axis.

8. The apparatus according to claim 2, characterized in that it further includes an automatic or semi-automatic loader, of the Cartesian type, for a rapid replacement of the injector piston when it is disengaged and out of axis with respect to the actuator, upon sliding of the brackets along the top horizontal guides.

9. The apparatus according to claim 8, characterized in that it further includes a device that moves the pot along the horizontal rails until it is disengaged from the top portion of the injection group, upon disengagement of the injector piston from the actuator and of the hydraulic jacks at one end thereof.

10. The apparatus according to claim 8, characterized in that it includes two or more injection groups connected to the mould so as to inject therein same or different alloys, simultaneously or at successive times.

11. The apparatus according to claim 8, characterized in that the press is arranged with a horizontal or vertical axis.

12. The apparatus according to claim 2, characterized in that it further includes a device that moves the pot along the horizontal rails until it is disengaged from the top portion of the injection group, upon disengagement of the injector piston from the actuator and of the hydraulic jacks at one end thereof.

13. The apparatus according to claim 2, characterized in that it includes two or more injection groups connected to the mould so as to inject therein same or different alloys, simultaneously or at successive times.

14. The apparatus according to claim 2, characterized in that the press is arranged with a horizontal or vertical axis.

15. The apparatus according to claim 1, characterized in that it further includes a device that moves the pot along the horizontal rails until it is disengaged from the top portion of the injection group, upon disengagement of the injector piston from the actuator and of the hydraulic jacks at one end thereof.

16. The apparatus according to claim 15, characterized in that it includes two or more injection groups connected to the mould so as to inject therein same or different alloys, simultaneously or at successive times.

17. The apparatus according to claim 15, characterized in that the press is arranged with a horizontal or vertical axis.

18. The apparatus according to claim 1, characterized in that it includes two or more injection groups connected to a same mould so as to inject therein same or different alloys, simultaneously or at successive times.

19. The apparatus according to claim 18, characterized in that the press is arranged with a horizontal or vertical axis.

20. The apparatus according to claim 1, characterized in that the press is arranged with a horizontal or vertical axis.

* * * * *